US012691988B1

(12) United States Patent
Farrell et al.

(10) Patent No.: US 12,691,988 B1
(45) Date of Patent: Jul. 28, 2026

(54) MOUNTING ASSEMBLIES FOR MARINE VESSELS

(71) Applicant: Brunswick Corporation, Mettawa, IL (US)

(72) Inventors: Kevin T. Farrell, Port Orange, FL (US); Troy J. Kollmann, New Smyrna Beach, FL (US); Arvind Kainth, Merritt Island, FL (US)

(73) Assignee: Brunswick Corporation, Mettawa, IL (US)

( * ) Notice: Subject to any disclaimer, the term of this patent is extended or adjusted under 35 U.S.C. 154(b) by 407 days.

(21) Appl. No.: 18/466,439

(22) Filed: Sep. 13, 2023

(51) Int. Cl.
*B63H 25/46* (2006.01)
*B63B 73/60* (2020.01)

(52) U.S. Cl.
CPC ..... *B63H 25/46* (2013.01); *B63B 73/60* (2020.01)

(58) Field of Classification Search
CPC . B63H 5/00; B63H 5/005; B63H 5/03; B63H 5/07; B63H 5/125; B63H 5/1252; B63H 5/1254; B63H 5/14; B63H 5/15; B63H 25/00; B63H 25/46; B63H 25/465; B63B 73/60
USPC ..... 440/38, 53, 54, 55, 57, 64
See application file for complete search history.

(56) References Cited

U.S. PATENT DOCUMENTS 3,515,088 A * 6/1970 Thulin ..... B63B 1/063 114/148
6,009,822 A * 1/2000 Aron ..... B63H 25/46 440/49
7,765,946 B1 8/2010 Berman et al.

* cited by examiner

*Primary Examiner* — Daniel V Venne
(74) *Attorney, Agent, or Firm* — Andrus Intellectual Property Law, LLP

(57) ABSTRACT

A mounting assembly is for installing a thruster on a variety of marine vessels having a liner and a hull separated from the liner by a gap. A through-bore in which the thruster is to be installed axially extends through the liner, the gap, and the hull, and because of differences in manufacturing and/or materials at least one dimensional variance exists in at least one of the liner, the gap, and the hull amongst the variety of marine vessels. The mounting assembly has a base member configured to be installed on the liner over the through-bore and an adjustment member that is adjustable and fixable in place relative to the base member to accommodate installation of the thruster at different axial positions in the through-bore so as to accommodate said at least one dimensional variance.

20 Claims, 7 Drawing Sheets

MOUNTING ASSEMBLIES FOR MARINE VESSELS

FIELD

The present disclosure relates to marine vessels, and specifically to mounting assemblies for coupling thrusters to marine vessels.

BACKGROUND

The following U.S. Patent is incorporated herein by reference in entirety.

U.S. Pat. No. 7,765,946 discloses systems and apparatuses for providing integrated boat thrusters which eliminate interfering with the integrity of the hull and undesirable drilling and cutting of the hull to accommodate separate glass tubes or pipes. The system provides integrally molded thruster tunnel sections within the hull and keystone inserts which are complementary to the molded thruster tunnel sections and complete the water flow chambers through the hull about the propellers.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain independent examples, a mounting assembly is for installing a thruster on a variety of marine vessels having a liner and a hull separated from the liner by a gap. A through-bore in which the thruster is to be installed axially extends through the liner, the gap, and the hull, and because of differences in manufacturing and/or materials at least one dimensional variance exists in at least one of the liner, the gap, and the hull amongst the variety of marine vessels. The mounting assembly comprises a base member configured to be installed on the liner over the through-bore, and an adjustment member that is adjustable and fixable in place relative to the base member to accommodate installation of the thruster at different axial positions in the through-bore so as to accommodate said at least one dimensional variance.

In certain independent examples, a method of installing a thruster on a variety of marine vessels having a liner and a hull separated from the liner by a gap, wherein a through-bore in which the thruster is to be installed axially extends through the liner, the gap, and the hull, and because of differences in manufacturing and/or materials, at least one dimensional variance exists in at least one of the liner, the gap, and the hull amongst the variety of marine vessels. The method comprises predetermining an axial position in the through-bore for the thruster by comparing a length characteristic of the thruster to a distance between an outside of the hull alongside the through-bore and an outside of the liner along the through-bore, installing a mounting assembly over the through-bore, the mounting assembly having a base member and an adjustment member configured to support the thruster relative to the through-bore, the adjustment member being axially adjustable and fixable in place relative to the base member to accommodate installation of the thruster at the axial position despite said at least one dimensional variance, adjusting the adjustment member relative to the hull to at least in part so that the thruster is located in the axial position, and installing the thruster in the through-bore.

In certain independent examples, a marine vessel comprises a liner and a hull that is separated from the liner by a gap. A through-bore axially extends through the liner, the gap, and the hull, wherein because of differences in manufacturing and/or materials, at least one dimensional variance compared to other marine vessels exists in at least one of the liner, the gap, and the hull. A thruster is installed in the through-bore, and a mounting assembly mounts the thruster to the marine vessel. The mounting assembly has a base member installed on the liner over the through-bore and an adjustment member supporting the thruster relative to the through-bore. The adjustment member is adjustable and fixable in place relative to the base member to accommodate installation of the thruster at a different axial position in the through-bore so as to accommodate said at least one dimensional variance.

Various other features, objects, and advantages will be made apparent from the following description taken together with the drawings.

BRIEF DESCRIPTION OF THE DRAWINGS

The present disclosure is described with reference to the following Figures. The same numbers are used throughout the Figures to reference like features and like components.

DETAILED DESCRIPTION

The present disclosure is related to mounting assemblies for marine vessels that are configured for mounting a thruster to the marine vessel. Thrusters are commonly mounted to the hull of the marine vessel to provide directional thrust force in the water to move the marine vessel. In certain examples, the thruster provides thrust in the port direction or starboard direction. The thrusters are mounted to the hull at the bow, stern, and/or any position therebetween. Note that while the present disclosure refers to thrusters mounted to the bow of the marine vessel (e.g., "bow thrusters"), the mounting assemblies described herein can be utilized for mounting thrusters at any position on the marine vessel, such as at the stern.

Figure 1:
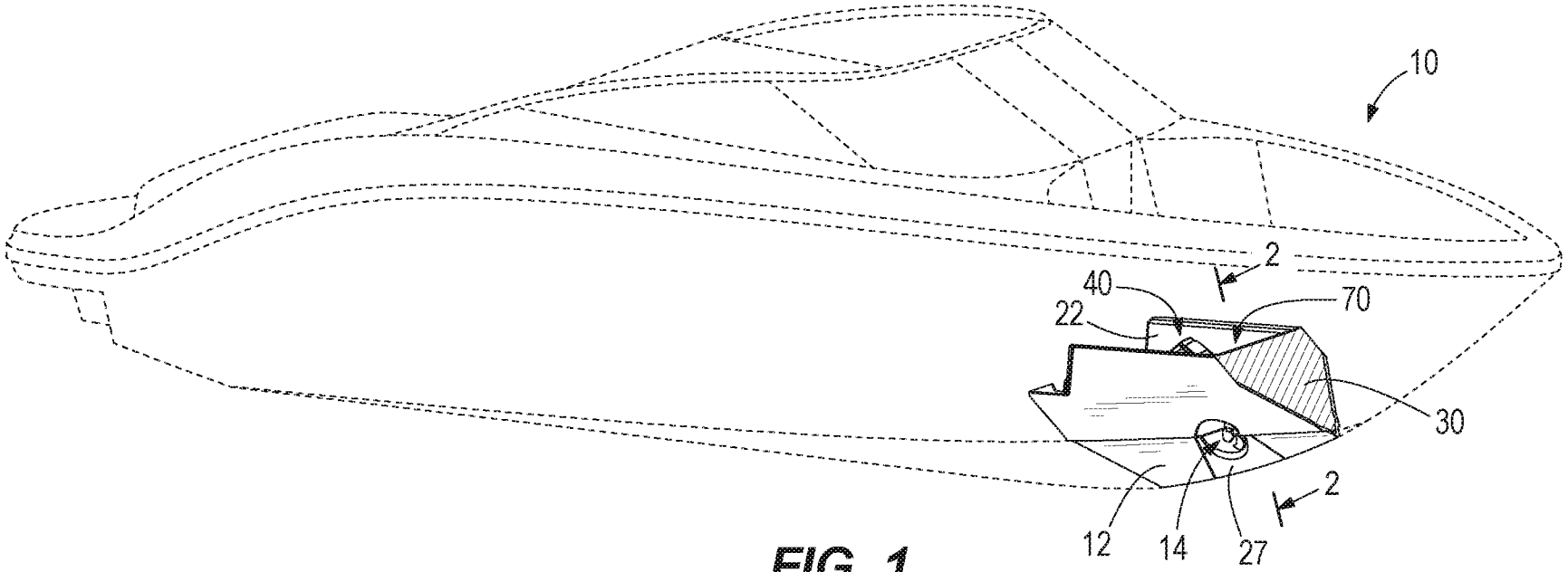
FIG. 1 is a perspective view of an example marine vessel according to the present disclosure.
Figure 2:
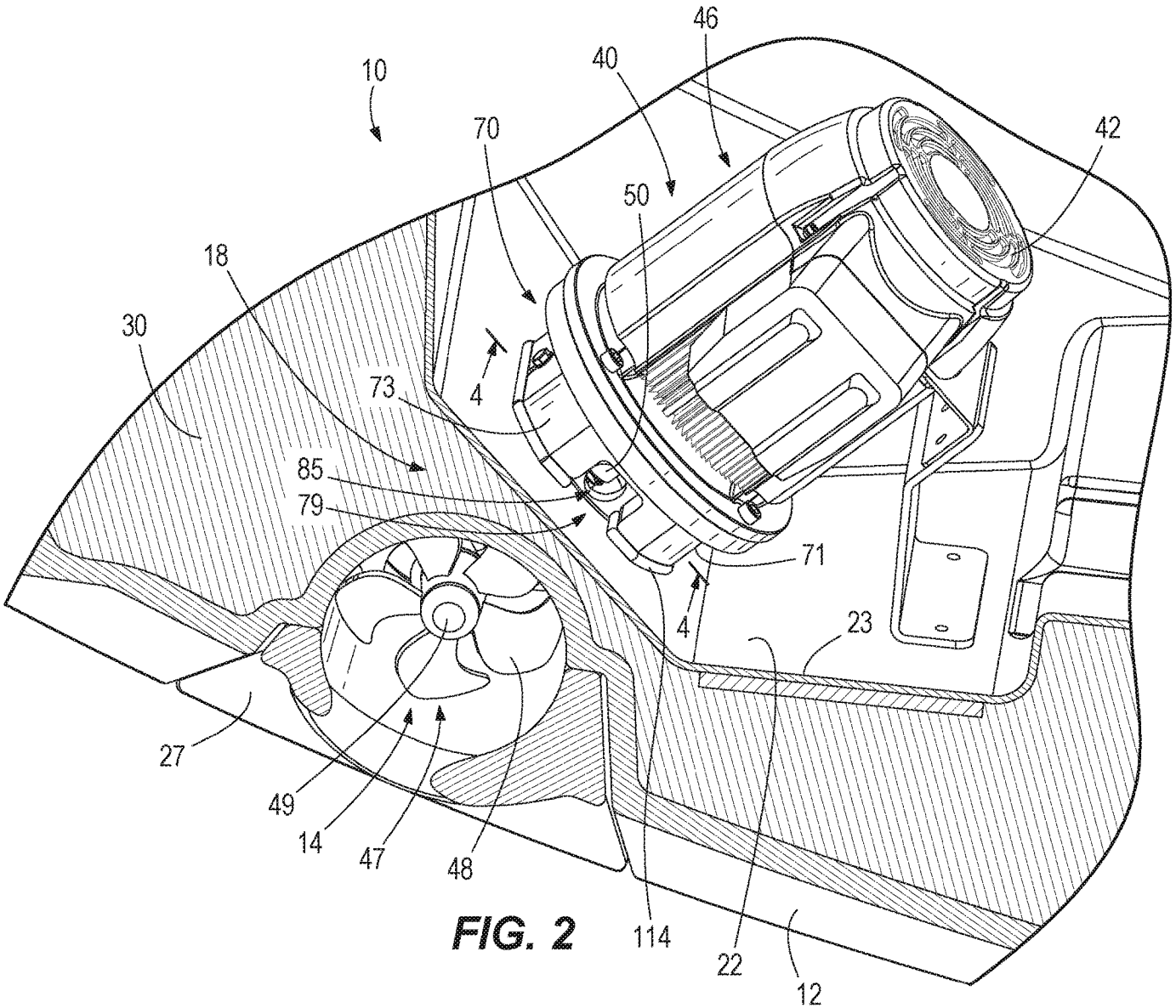
FIG. 2 is a cross-sectional view of the example marine vessel of FIG. 1 along line 2-2 on FIG. 1.

FIG. 1 depicts an example marine vessel 10 according to the present disclosure. Note that the majority of the marine vessel 10 is depicted in dashed lines and a portion of the bow of the marine vessel 10 to which a thruster 40 is mounted (described in greater detail herein below) is depicted in sold lines. FIG. 2 depicts the portion of the marine vessel 10 which the thruster 40 is mounted in greater detail.

The marine vessel 10 is manufactured with an outer hull 12, an inner liner 22, and insulation 30 in a gap 18 between the hull 12 and the liner 22. The marine vessel 10 also defines a tunnel 14 in which a propulsor, such as a propeller 48, impeller and/or the like, of the thruster 40 is located. The tunnel 14 is submerged in the water and the propeller 48 generates thrust forces in the water to thereby move the marine vessel. The marine vessel 10 also includes a through-bore 16 that intersects with the tunnel 14 (FIG. 4) and in which the thruster 40 is axially installed. As such, the thruster 40 extends through the liner 22, the gap 18, and the hull 12. Note that components, such as the drive shaft 43 of the thruster 40, axially extend in the through-bore 16. The motor 42 of the thruster 40 is coupled to the liner 22 via a mounting assembly 70 according to the present disclosure. Additional components and features of the thruster 40 are described in more detail herein below.

The manner in which the tunnel 14 and the through-bore 16 are defined in the marine vessel 10 can vary. In one non-limiting example, the tunnel and through-bore are drilled into the fiberglass hull. A drill cuts holes in the port and starboard of the hull and the insulation between the holes is removed. A fiberglass tube is then inserted between the holes, and the ends of the tube are glassed or sealed to the hull thereby preventing water infiltration into the boat. The through-bore is then drilled through the liner, the insulation, and the sidewall of the tube.

In another example, the fiberglass hull defines a cavity and a separate, complementary and molded "keystone" insert is secured and bonded to the hull in the cavity to define the tunnel. Note that FIGS. 1-2 depict this example construction with the keystone insert 27. The through-bore is then drilled through the liner, the insulation, and the portion of the hull partially defining the tunnel. In still other examples, the tunnel and the through-bore are defined in the marine vessel during the original manufacture of the marine vessel.

The present inventors recognized that the construction, the material characteristics, and/or manufacturing tolerances of the hull, the components defining the tunnels, the gap and/or the insulation between the liner and the hull, and/or the liner, can vary in a variety of marine vessels. As such, one or more dimensional variances can exist in the liner, the gap, and the hull. The dimensional variances for example include the axial distance/height or thickness of the hull, the gap, the insulation, and the liner. The present inventors also recognized that conventional mounting saddles and/or mounting assemblies cannot account for dimensional variances in the components of the marine vessel and/or are not 'one-size fits all' components. For instance, conventional mounting saddles and/or mounting assemblies may not be able to account for dimensional variance caused by the thickness of the tube glassed into the hull, the width of the gap between the hull and the liner, and/or the thickness of the liner.

As such, the present inventors endeavored to develop the mounting assemblies of the present disclosure that can be utilized to mount thrusters to the marine vessel regardless of the dimensional variances caused by the construction of the tunnel in the marine vessel and/or the material variances or tolerances of the components of the marine vessel.

Figure 3:
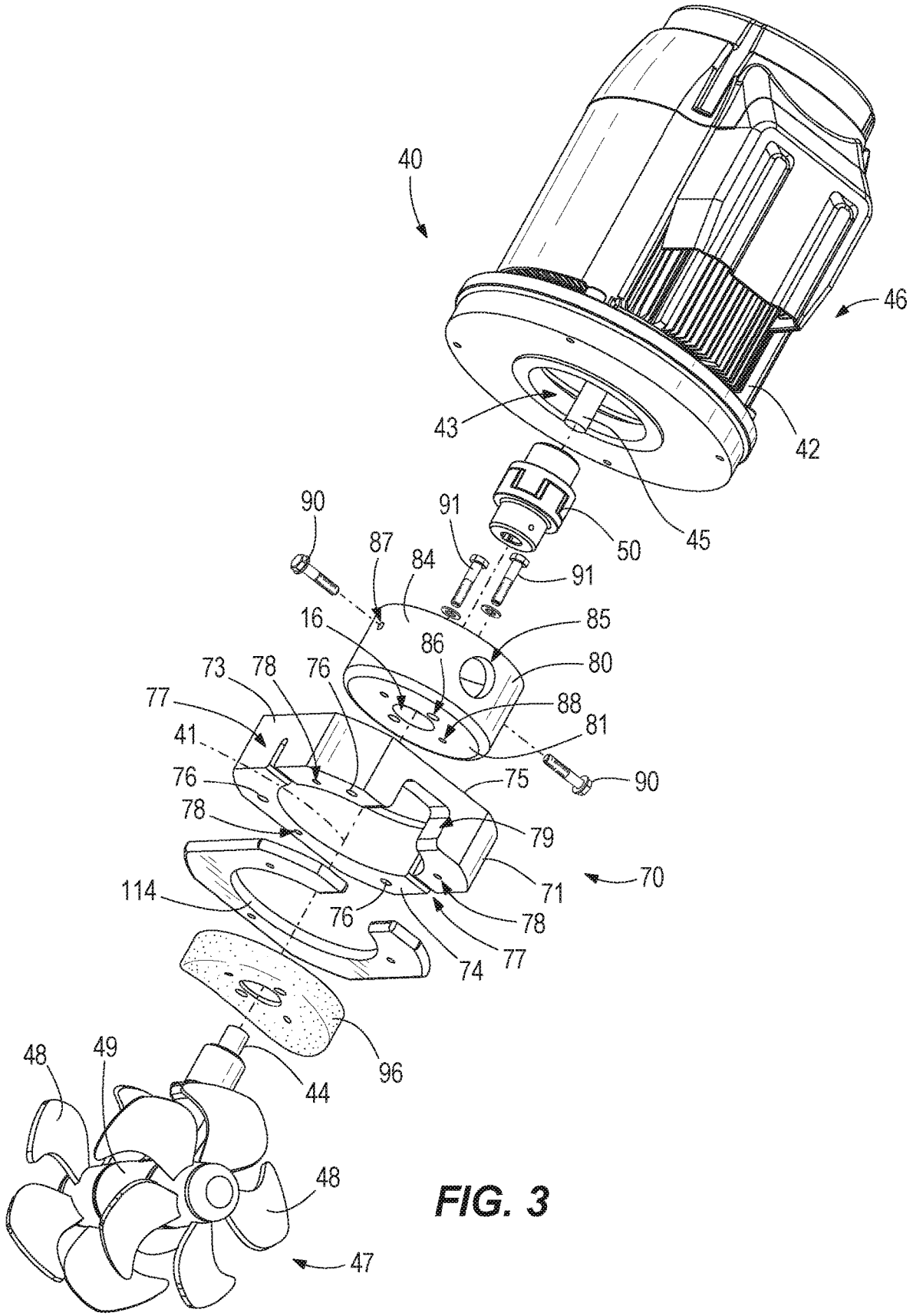
FIG. 3 is an exploded view of an example thruster according to the present disclosure.
Figure 4:
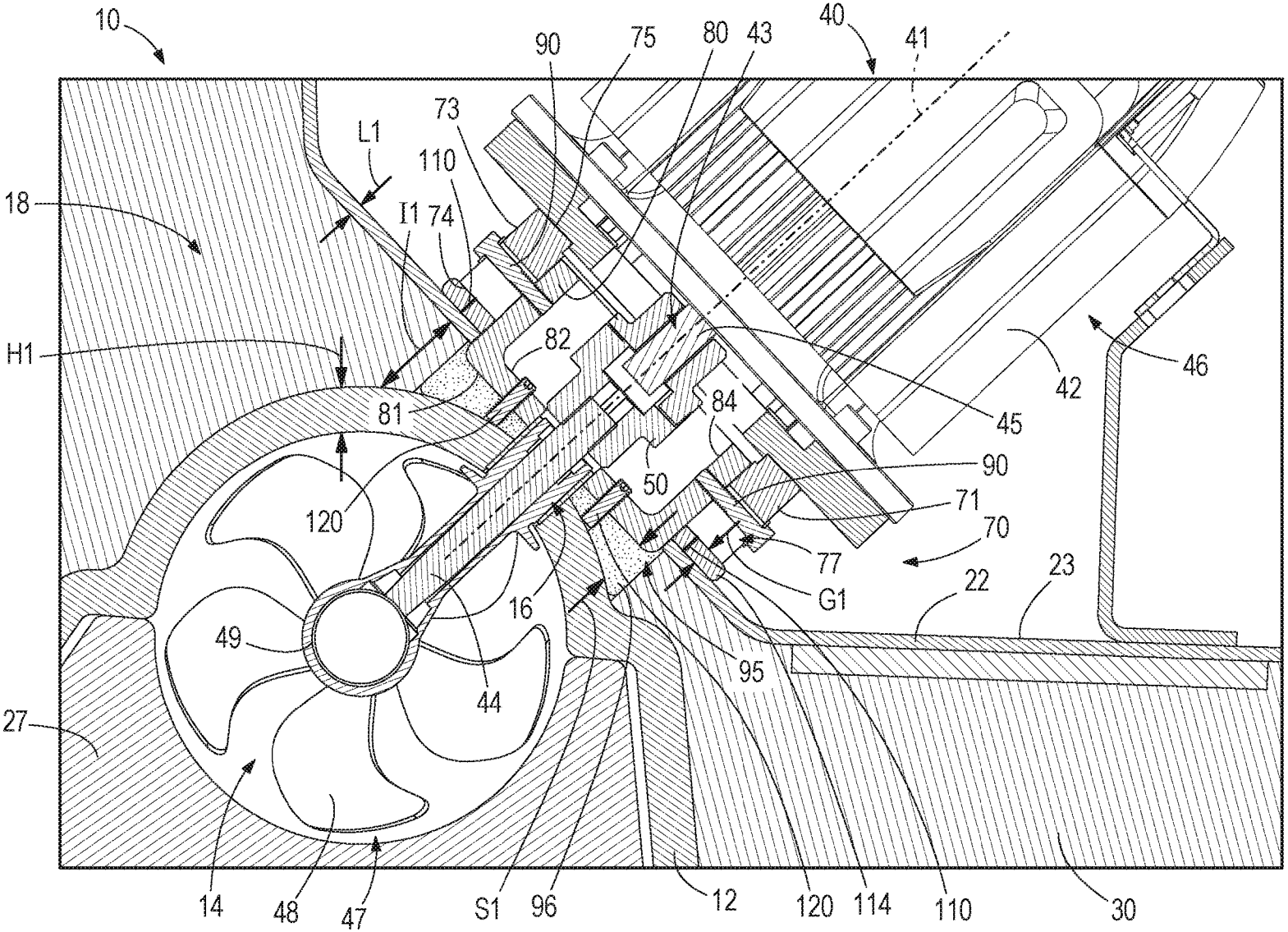
FIGS. 4-6 are cross-sectional views of an example mounting assembly and example thruster according to the present disclosure coupled to different marine vessels.

FIG. 3 illustrates an example thruster 40 according to the present disclosure and an example mounting assembly 70 according to the present disclosure. The thruster 40 has a motor 42 at a first thruster end 46 and one or more propellers 48 at an opposite second thruster end 47. A drive shaft 43 extends between the ends 46, 47 along an axis 41, and the opposing ends of the drive shaft 43 are coupled to the motor 42 and a propeller hub 49, respectively. Note that FIG. 3 depicts the drive shaft 43 comprising a first section 44 and a second section 45 and a coupler 50 is for connecting the two sections 44, 45 to each other. This construction of the drive shaft 43 facilitates installation of the thruster 40 into the tunnel 14 and to the liner 22. For example, during installation of the thruster 40 the propellers 48, the hub 49, and the first section 44 are inserted into the tunnel 14 such that the first section 44 extends through the through-bore 16 (FIG. 4). The coupler 50 then connects the first section 44 to the second section 45 of the drive shaft 43, and the mounting assembly 70 (described further herein) couples the motor 42 to the liner 22 (FIG. 4).

After installation of the thruster 40, the motor 42 rotates the drive shaft 43 and the coupler 50 about the axis 41. The propeller hub 49 transforms rotation of the drive shaft 43 with a mechanical assembly (e.g., including a bevel gear set and/or the like) to thereby rotate the propellers 48 and generate thrust for the marine vessel 10 in either the starboard direction or the port direction.

The mounting assembly 70 includes a base member 71 configured to be coupled to the liner 22 (FIG. 4) and over the through-bore 16 (FIG. 4). The base member 71 has a first surface 74 that faces the liner 22 and an opposite second surface 75 that faces the motor 42. In certain examples, the motor 42 abuts the second surface 75 and/or one or more fasteners (not depicted; e.g., bolts) couple the motor 42 to the second surface 75. The base member 71 includes a perimeter sidewall 73 and a cutout 79 (FIG. 3) in the sidewall 73. Slots 77 (FIG. 4) are also defined in the sidewall 73, and each slot 77 is on an opposing side of the base member 71. The base member 71 has a plurality of bores 76 that extend between the surfaces 74, 75 through which fasteners (not depicted; e.g., bolts) extend to couple the base member 71 to the liner 22 (FIG. 4). The base member 71 has a plurality of secondary bores 78 (FIG. 3) that extend axially from the first surface 74 toward the second surface 75. One or more adjustment device 110, are configured to facilitate an axial adjustment of a standoff distance of the base member 71 relative to the liner 22 prior to fixing the base member 71 in place relative to the liner 22. In a non-limiting example, the adjustment devices 110 include a plurality of secondary bores 78 (FIG. 3) that extend axially in the base member 71 from the first surface 74 toward the second surface 75. The secondary bores 78 are configured to receive one or more screws (not depicted; e.g., set screws, hex-head screws). In a non-limiting example, the secondary bores 78 are threaded and the adjustment devices 110 include one or more screws having threads that engage with the threads of the secondary bores 78. In other examples, the adjustment device 110 is coupled to and extends from the base member 71 toward the liner 22.

A sealant pad 114 is positioned between the base member 71 and the liner 22 (FIG. 4) and configured to form a fluid-tight seal therebetween. The size and the shape of the sealant pad 114 may vary from what is shown and described. In the example depicted in FIG. 3 the sealant pad 114 is "C" shape. In certain examples, the sealant pad 114 is compressed and/or sandwiched between the base member 71 and the liner 22. The present inventors recognized that in certain examples, the standoff distance G1 (FIG. 4) between the base member 71 and the liner 22 must be optimized such that the sealant pad 114 is properly compressed between the base member and the liner 22. In one non-limiting example, the standoff distance G1 is in the range of 6.0-15.0 mm and preferably in the range of 10.0-15.0 mm.

If the standoff distance G1 is less than a predetermined standoff distance (e.g., 6.0-15.0 mm), the compression forces acting on the sealant pad 114 are large/excessive and/or the compressed height of the sealant pad 114 is less than an optimum compressed height such that a fluid-tight seal does not properly form between the liner 22 and the base member 71. If the standoff distance G1 is more than a predetermined standoff distance, the sealant pad 114 will not be properly compressed between the liner 22 and the base member 71 and therefore the fluid-tight seal does not form therebetween. As such, the present inventors developed the base member 71 with the secondary bores 78 and the adjustment devices 110 such that base member 71 can be properly spaced from the liner 22. In one non-limiting example, the technician determines the predetermined standoff distance G1 based on the specific sealant pad 114 to be used. The technician then inserts the adjustment devices 110 into the secondary bores 78 such that the adjustment devices 110 extend a distance from the first surface 74 of the base member 71 that corresponds to the standoff distance G1. When the base member 71 is coupled to the liner 22 with the sealant pad 114 therebetween, the adjustment device(s) 110 prevent the base member 71 from being moved too close to the liner 22 thereby properly setting the standoff distance G1 without over-compressing the sealant pad 114.

The mounting assembly 70 further includes an adjustment member 80 that is configured to support the thruster 40 relative to the through-bore 16 (FIG. 4) and is adjustable and fixable in place relative to the base member 71 to accommodate installation of the thruster 40 at different axial positions in the through-bore 16 so as to accommodate at least one-dimensional variance. In one non-limiting example, as further described herein below, the adjustment member 80 is axially adjustable relative to the base member 71 and thus relative to the through-bore 16 during installation of the mounting assembly 70.

The adjustment member 80 has a first surface 81 that faces the hull 12 (FIG. 4) and an opposite second surface 82 (FIG. 4) that faces the motor 42. The adjustment member 80 includes a perimeter sidewall 84 and a cutout 85 in the sidewall 84. Holes 86 are defined in the adjustment member 80 to facilitate coupling of the adjustment member 80 to the hull 12 (FIG. 4) via bolts 91. That is, the bolts 91 are inserted through the holes 86 and engage the hull 12 to thereby secure the adjustment member 80 to the hull 12. Additional holes 87 are defined in the sidewall 84 such that a fixing device 90, such as a screw, set screw, or bolt, can be inserted therethrough to fix the adjustment member 80 in place relative to the base member 71 (described in greater detail herein below). Note that the through-bore 16 (FIG. 4) also extends through the adjustment member 80. In certain examples, the cutouts 79, 85 facilitate viewing of the axial position of the adjustment member 80 relative to the base member 71 and/or the through-bore 16 and/or axial position of the coupler 50 and the first and second sections 44, 45 of the drive shaft 43 thereby facilitating installation of the thruster 40 at the different axial positions.

The adjustment member 80 has a plurality of bores 88 that extend axially in a direction from the first surface 81 toward the second surface 82. The bores 88 are configured to each receive an adjustment device 120 configured to facilitate an axial adjustment of a standoff distance S1 (FIG. 4) of the adjustment member 80 relative to the hull 12 prior to fixing the adjustment member 80 in place relative to the hull 12 (described further herein). In one example, the bores 88 are threaded and the adjustment devices 120 include screws (e.g., set screws, hex-head screws) having threads that engage with the threads in the bores 88.

When the adjustment member 80 is coupled to the hull 12, a cavity 95 (FIG. 4) is defined between the first surface 81 of the adjustment member 80 and the outside diameter surface of the hull 12. The cavity 95 is filled with sealant 96 (note that FIG. 3 depicts the sealant 96 as an undulated disc of material) such that a fluid-tight seal is formed between the hull 12 and the adjustment member 80. In certain examples, the sealant 96 is a flowable material that cures over time after being placed into the cavity 95. Installation of the sealant 96 is described in greater detail herein below. In certain examples, the sealant 96 is compressed and/or sandwiched between the adjustment member 80 and the hull 12. The present inventors recognized that in certain examples, the standoff distance S1 between the adjustment member 80 and the hull 12 must be optimized such that the sealant 96 properly cures and forms the above-noted seal therebetween. Note that while the standoff distance S1 is exemplary depicted in FIGS. 4-6 alongside the through-bore 16, in other examples the standoff distance S1 can be measured at other positions. In one non-limiting example, the standoff distance S1 corresponds to a minimum thickness of the sealant 96 necessary to properly form the seal between the adjustment member 80 and the hull 12. In one non-limiting example, the standoff distance S1 corresponds to a minimum thickness of 6.0 millimeters (mm) for the sealant 96. In one non-limiting example, the standoff distance S1 is in the range of 6.0-15.0 mm and preferably in the range of 10.0-15.0 mm.

If the standoff distance S1 is less than or greater than a predetermined standoff distance (e.g., 10.0 mm, 13.0 mm, 15.0 mm) or outside a predetermined range (e.g., 10.0-15.0 mm), the sealant 96 may not properly cure and/or properly form the seal between the adjustment member 80 and the hull 12 (FIG. 4). As such, the present inventors developed the base member 71 with the secondary bores 78 and the adjustment devices 110 such that base member 71 can be properly spaced from the liner 22. In one non-limiting example, the technician determines that predetermined standoff distance S1 based on the determined parameters of the sealant 96 to be used (e.g., the minimum thickness for the sealant 96 must be at least 6.0 mm). The technician then inserts the adjustment devices 120 into the bores 80 such that the adjustment device(s) 120 extend a distance from the first surface 81 of the adjustment member 80 that corresponds to the standoff distance S1. The sealant 96 is then inserted into the cavity 95 (e.g., with a caulk-gun style applicator) and the adjustment member 80 (which may or may not be fixedly coupled to the base member 71) is secured to the hull 12 with one or more bolts 91 (see FIG. 3). As such, the adjustment device(s) 120 prevent the adjustment member 80 from being moved too close to the hull 12 thereby properly setting the standoff distance S1 and preventing over-compressing the sealant 96.

Figure 5:
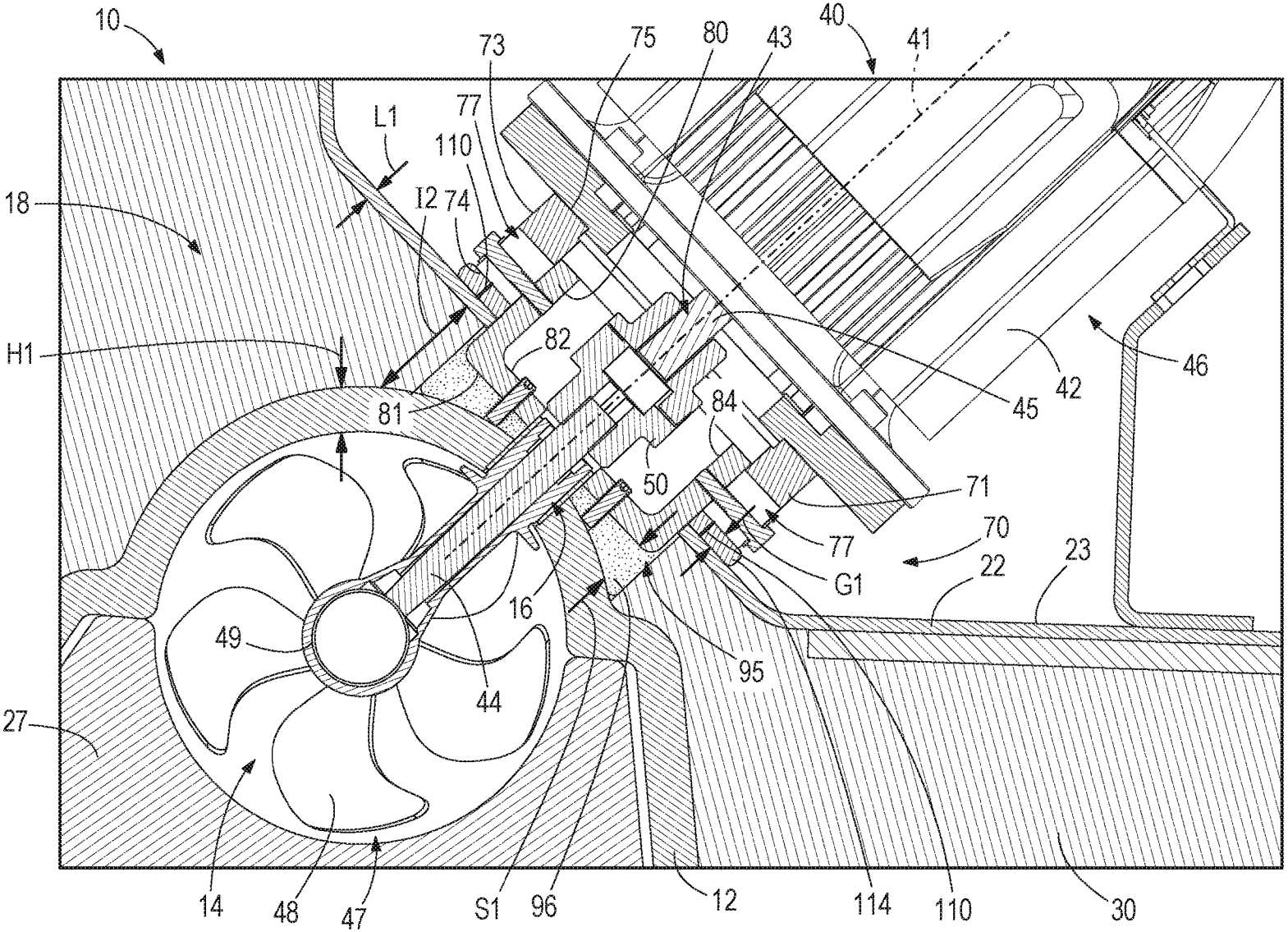
Figure 6:
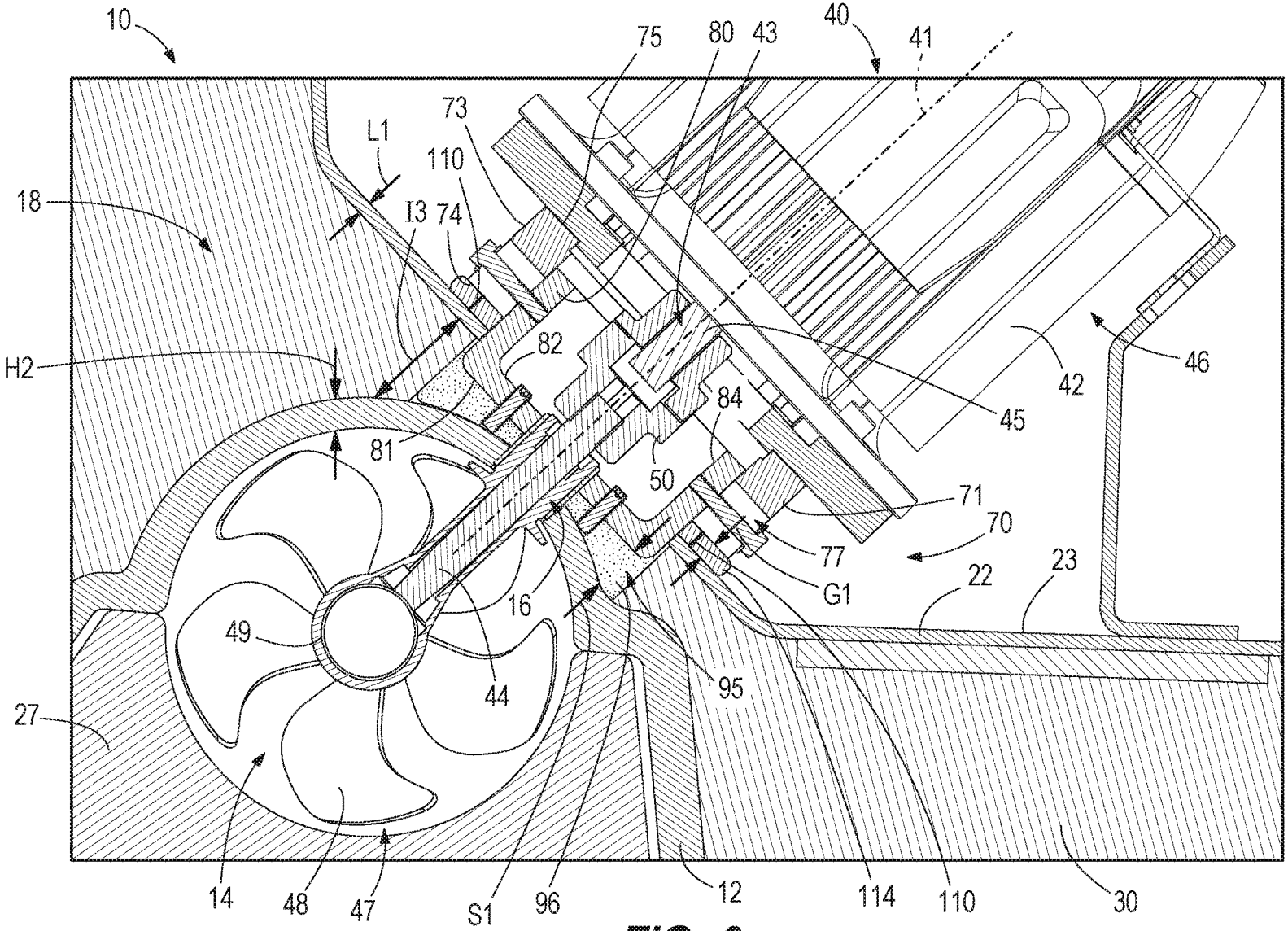

Turning now to FIGS. 4-6, the mounting assembly 70 is depicted coupled to different marine vessels 10. For purposes of illustrating the ability of the mounting assembly 70 to accommodate installation of the thruster 40 at different axial positions in the through-bore 16 so as to accommodate at least one dimensional variance of the components of the marine vessel 10, the example installation depicted in FIG. 4 is described hereinbelow as a 'baseline' condition and the example installations depicted in FIGS. 5-6 include at least one example dimensional variance of the components of the marine vessel 10 relative to the components of the marine vessel 10 depicted in FIG. 4.

The example marine vessel 10 depicted in FIG. 4 has a hull 12 defining a tunnel 14 in which the propellers 48 and the hub 49 of the thruster 40 are positioned. The hull 12 has a first hull thickness H1, and the liner 22 has a first liner thickness L1. The gap 18 between the hull 12 and the liner 22 is filled with insulation 30 such that the insulation 30 has generally axial first insulation thickness I1 near the through-bore 16. The through-bore 16 extends through the hull 12, the gap 18, the liner 22, and the adjustment member 80. The drive shaft 43 of the thruster 40 extends in through-bore 16.

The adjustment devices 120 are coupled to the adjustment member 80 to define the standoff distance S1 between the adjustment member 80 and the hull 12. The cavity 95 is filled with an appropriate amount of sealant 96 to form a seal between the hull 12 and the adjustment member 80.

The adjustment device is 110 coupled to the base member 71 to define the standoff distance G1 between the liner 22 and the base member 71 so that the sealant pad 114 is properly located and/or compressed between the base member 71 and the liner 22.

The fixing devices 90 are positioned in holes 87 in the sidewall 84 of the adjustment member 80 and the slots 77 of the base member 71 and thereby fix the position of the adjustment member 80 relative to the base member 71. The motor 42 is coupled to the base member 71, and as such, the thruster 40 is properly coupled to the hull 12 and the liner 22 of the marine vessel 10 via the mounting assembly 70 in a first axial position with at least a portion thereof in the through-bore 16. Note that the axial position of the thruster 40 is based at least in part on an axial length characteristic of the thruster 40 (e.g., such as the cumulative axial length of the first and second sections 44, 45 of the drive shaft 43 with the coupler 50) in view of said at least one dimensional variance.

Turning now to FIG. 5, the marine vessel 10 has a dimensional variance being an increased thickness of the gap 18 and the insulation 30 near the through-bore 16 such that the insulation 30 has a second insulation thickness 12 that is greater than the first insulation thickness I1 (FIG. 4). To accommodate installation of the thruster 40 to this marine vessel 10, the adjustment member 80 is configured to extend or telescope relative to the base member 71 such that the thruster 40 and the other components necessary for proper installation of the thruster 40 (e.g., the sealant 96 and the sealant pad 114) are properly installed on the marine vessel 10. As such, the thruster 40 is properly coupled to the hull 12 and the liner 22 of the marine vessel 10 via the mounting assembly 70 in a second axial position with at least a portion thereof in the through-bore 16. Note that in view of the increased thickness of the insulation 30, if the adjustment member 80 did not telescope in an axial direction toward the hull 12, the cavity 95 would be too large and the sealant 96 would not properly form a seal between the hull 12 and the adjustment member 80. Note that the fixing device 90 is in a different axial position in the slots in comparison to the fixing device 90 in FIG. 4. Further note that the coupler 50 is capable of accounting for the differences in the axial positions of the first and second sections 44, 45 of the drive shaft 43 due to the increased thickness of the insulation 30.

FIG. 6 depicts a marine vessel 10 having a different dimensional variance. In this example, the hull 12 has a second hull thickness H2 that is less than the first hull thickness H1 depicted in FIG. 4. The dimensional variance of the decreased hull thickness is accommodated by the mounting assembly 70. Like the example described above with respect to FIG. 5, the adjustment member 80 is configured to extend or telescope relative to the base member 71. As such, the thruster 40 is properly coupled to the hull 12 and the liner 22 of the marine vessel 10 via the mounting assembly 70 in a third axial position with at least a portion thereof in the through-bore 16. Note that the fixing devices 90 are in a different axial position in the slots 77 in comparison to the fixing devices 90 in FIGS. 4-5. Further note that the coupler 50 is configured to accommodate different the axial positions of the first and second sections 44, 45 of the drive shaft 43. In other examples, the mounting assembly 70 is configured to account for multiple dimensional variances at the same time.

In certain examples, the adjustment devices 110, 120 can be utilized to account for one or more dimensional variances. In these examples, the adjustment device 110 coupled to the base member 71 is configured to facilitate axial adjustment of the base member 71 relative to the liner 22 prior to fixing the base member 71 in place on the liner 22 and the adjustment device 120 coupled to the adjustment member 80 is configured to facilitate axial adjustment of the adjustment member 80 relative to the hull 12 prior to fixing the adjustment member 80 in place relative to the base member 71. As such, the axial adjustment of the base member 71 and/or the axial adjustment of the adjustment member 80 can be cumulative so as to provide a relatively larger overall axial adjustment of the mounting assembly 70.

Figure 7:
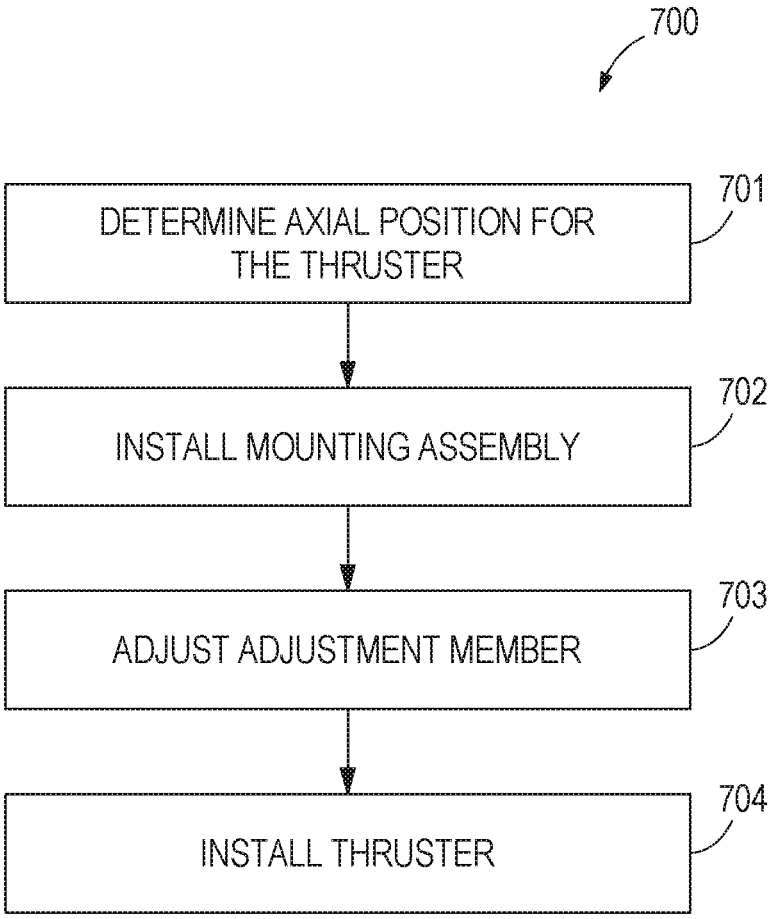
FIG. 7 is a schematic diagram of an example method according to the present disclosure.

FIG. 7 is an example method 700 of installing the thruster 40 to a variety of marine vessels 10. Note that the method described hereinbelow can include any additional features, components, and/or steps noted above with respect to the examples depicted in FIGS. 1-6. Further note that any components referenced hereinbelow are provided in FIGS. 1-6.

At step 701, the method begins 700 by predetermining an axial position in the through-bore 16 for the thruster 40 by comparing a length characteristic of the thruster 40 to a distance between an outside of the hull 12 alongside the through-bore 16 and an outside surface 23 of the liner 22 along the through-bore 16. At step 702 the mounting assembly 70 is installed over the through-bore 16. The adjustment member 80 is axially adjustable and fixable in place relative to the base member 71 to accommodate installation of the thruster 40 at the axial position despite said at least one dimensional variance. The adjustment member 80 is adjusted at step 703 relative to the hull 12 to at least in part so that the thruster 40 is located in the axial position. At step 704 the thruster 40 is installed in the through-bore 16.

Optionally, the step of adjusting the adjustment member 80 relative to the hull 12 includes adjusting the standoff distance S1 between the adjustment member 80 and the hull 12. Optionally, the method 700 further includes, prior to installing the thruster in the through-bore 16, adjusting the base member 71 relative to the liner 22 further to locate the thruster 40 in the axial position.

In certain examples, a mounting assembly is for installing a thruster on a variety of marine vessels having a liner and a hull separated from the liner by a gap. A through-bore in which the thruster is to be installed axially extends through the liner, the gap, and the hull, and because of differences in manufacturing and/or materials at least one dimensional variance exists in at least one of the liner, the gap, and the hull amongst the variety of marine vessels. The mounting assembly comprising a base member configured to be installed on the liner over the through-bore, and an adjustment member that is adjustable and fixable in place relative to the base member to accommodate installation of the thruster at different axial positions in the through-bore so as to accommodate said at least one dimensional variance.

Optionally, the said at least one dimensional variance comprises a thickness of said at least one of the liner, the gap, and the hull. Optionally, the different axial positions are based on an axial length characteristic of the thruster in view of said at least one dimensional variance. Optionally, the adjustment member is axially adjustable relative to the base member and thus relative to the through-bore during installation of the mounting assembly. Optionally, an adjustment device is configured to facilitate an axial adjustment of a standoff distance of the base member relative to the liner prior to fixing the base member in place. Optionally, the adjustment device comprises at least one set screw. Optionally, an adjustment device is configured to facilitate an axial adjustment of a standoff distance of the adjustment member relative to the hull prior to fixing the adjustment member in place. Optionally, the adjustment device comprises at least one set screw. Optionally, a fixing device is configured to fix the adjustment member in place relative to the base member. Optionally, the fixing device comprises at least one set screw. Optionally, a first adjustment device is configured to facilitate an axial adjustment of the base member relative to the liner prior to fixing the base member in place on the liner and a second adjustment device is configured to facilitate an axial adjustment of the adjustment member relative to the hull prior to fixing the adjustment member in place relative to the base member. The axial adjustment of the base member and the axial adjustment of the adjustment member are cumulative so as to provide a relatively larger overall axial adjustment of the mounting assembly. Optionally, a fixing device is configured to fix the adjustment member in place relative to the base member. Optionally, the mounting assembly according to claim 1, further comprising a cutout in the base member which facilitates viewing of an axial position of the adjustment member relative to the through-bore, thereby facilitating installation of the thruster at the different axial positions. Optionally, the adjustment member is telescopically adjustable relative to the base member.

In certain examples, a method of installing a thruster on a variety of marine vessels having a liner and a hull separated from the liner by a gap, wherein a through-bore in which the thruster is to be installed axially extends through the liner, the gap, and the hull, and because of differences in manufacturing and/or materials, at least one dimensional variance exists in at least one of the liner, the gap, and the hull amongst the variety of marine vessels, the method comprising predetermining an axial position in the through-bore for the thruster by comparing a length characteristic of the thruster to a distance between an outside of the hull alongside the through-bore and an outside of the liner along the through-bore, installing a mounting assembly over the through-bore, the mounting assembly having a base member and an adjustment member configured to support the thruster relative to the through-bore, the adjustment member being axially adjustable and fixable in place relative to the base member to accommodate installation of the thruster at the axial position despite said at least one dimensional variance, adjusting the adjustment member relative to the hull to at least in part so that the thruster is located in the axial position, and installing the thruster in the through-bore.

Optionally, the adjusting the adjustment member relative to the hull comprises adjusting a standoff distance between the adjustment member and the hull. Optionally, the method includes, prior to installing the thruster in the through-bore, adjusting the base member relative to the liner further to locate the thruster in the axial position. Optionally, the adjusting the base member relative to the liner comprises adjusting a standoff distance between the base member and the liner. Optionally, the method includes, thereafter fixing the adjustment member relative to the base member.

In certain examples, a marine vessel comprises a liner and a hull that is separated from the liner by a gap. A through-bore axially extends through the liner, the gap, and the hull, and wherein because of differences in manufacturing and/or materials, at least one dimensional variance compared to other marine vessels exists in at least one of the liner, the gap, and the hull. A thruster installed in the through-bore, and a mounting assembly which mounts the thruster to the marine vessel. The mounting assembly having a base member installed on the liner over the through-bore, and an adjustment member supporting the thruster relative to the through-bore. The adjustment member is adjustable and fixable in place relative to the base member to accommodate installation of the thruster at a different axial position in the through-bore so as to accommodate said at least one dimensional variance.

Citations to a number of references are made herein. The cited references are incorporated by reference herein in their entireties. In the event that there is an inconsistency between a definition of a term in the specification as compared to a definition of the term in a cited reference, the term should be interpreted based on the definition in the specification.

In the present description, certain terms have been used for brevity, clarity, and understanding. No unnecessary limitations are to be inferred therefrom beyond the requirement of the prior art because such terms are used for descriptive purposes and are intended to be broadly construed. The different apparatuses, systems, and method steps described herein may be used alone or in combination with other apparatuses, systems, and methods. It is to be expected that various equivalents, alternatives and modifications are possible within the scope of the appended claims.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A mounting assembly for installing a thruster on a variety of marine vessels having a liner and a hull separated from the liner by a gap, wherein a through-bore in which the thruster is to be installed axially extends through the liner, the gap, and the hull, and wherein because of differences in manufacturing and/or materials at least one dimensional variance exists in at least one of the liner, the gap, and the hull amongst the variety of marine vessels, the mounting assembly comprising:

a base member configured to be installed on the liner over the through-bore; and an adjustment member that is adjustable and fixable in place relative to the base member to accommodate installation of the thruster at different axial positions in the through-bore so as to accommodate said at least one dimensional variance.

2. The mounting assembly according to claim 1, wherein said at least one dimensional variance comprises a thickness of said at least one of the liner, the gap, and the hull.

3. The mounting assembly according to claim 1, wherein the different axial positions are based on an axial length characteristic of the thruster in view of said at least one dimensional variance.

4. The mounting assembly according to claim 1, wherein the adjustment member is axially adjustable relative to the base member and thus relative to the through-bore during installation of the mounting assembly.

5. The mounting assembly according to claim 1, further comprising an adjustment device configured to facilitate an axial adjustment of an standoff distance of the base member relative to the liner prior to fixing the base member in place.

6. The mounting assembly according to claim 5, wherein the adjustment device comprises at least one screw.

7. The mounting assembly according to claim 1, further comprising an adjustment device configured to facilitate an axial adjustment of a standoff distance of the adjustment member relative to the hull prior to fixing the adjustment member in place.

8. The mounting assembly according to claim 7, wherein the adjustment device comprises at least one screw.

9. The mounting assembly according to claim 1, further comprising a fixing device configured to fix the adjustment member in place relative to the base member.

10. The mounting assembly according to claim 9, wherein the fixing device comprises at least one set screw.

11. The mounting assembly according to claim 1, further comprising a first adjustment device configured to facilitate an axial adjustment of the base member relative to the liner prior to fixing the base member in place on the liner; and a second adjustment device configured to facilitate an axial adjustment of the adjustment member relative to the hull prior to fixing the adjustment member in place relative to the base member;

wherein the axial adjustment of the base member and the axial adjustment of the adjustment member are cumulative so as to provide a relatively larger overall axial adjustment of the mounting assembly.

12. The mounting assembly according to claim 11, further comprising a fixing device configured to fix the adjustment member in place relative to the base member.

13. The mounting assembly according to claim 1, further comprising a cutout in the base member which facilitates viewing of an axial position of the adjustment member relative to the through-bore, thereby facilitating installation of the thruster at the different axial positions.

14. The mounting assembly according to claim 1, wherein the adjustment member is telescopically adjustable relative to the base member.

15. A method of installing a thruster on a variety of marine vessels having a liner and a hull separated from the liner by a gap, wherein a through-bore in which the thruster is to be installed axially extends through the liner, the gap, and the hull, and wherein because of differences in manufacturing and/or materials, at least one dimensional variance exists in at least one of the liner, the gap, and the hull amongst the variety of marine vessels, the method comprising:

predetermining an axial position in the through-bore for the thruster by comparing a length characteristic of the thruster to a distance between an outside of the hull alongside the through-bore and an outside of the liner along the through-bore;

installing a mounting assembly over the through-bore, the mounting assembly having a base member and an adjustment member configured to support the thruster relative to the through-bore, the adjustment member being axially adjustable and fixable in place relative to the base member to accommodate installation of the thruster at the axial position despite said at least one dimensional variance;

adjusting the adjustment member relative to the hull to at least in part so that the thruster is located in the axial position; and installing the thruster in the through-bore.

16. The method according to claim 15, wherein adjusting the adjustment member relative to the hull comprises adjusting a standoff distance between the adjustment member and the hull.

17. The method according to claim 15, further comprising, prior to installing the thruster in the through-bore, adjusting the base member relative to the liner further to locate the thruster in the axial position.

18. The method according to claim 17, wherein adjusting the base member relative to the liner comprises adjusting a standoff distance between the base member and the liner.

19. The method according to claim 15, further comprising thereafter fixing the adjustment member relative to the base member.

20. A marine vessel comprising:

a liner and a hull that is separated from the liner by a gap, wherein a through-bore axially extends through the liner, the gap, and the hull, and wherein because of differences in manufacturing and/or materials, at least one dimensional variance compared to other marine vessels exists in at least one of the liner, the gap, and the hull;

a thruster installed in the through-bore; and a mounting assembly which mounts the thruster to the marine vessel, the mounting assembly having a base member installed on the liner over the through-bore, and an adjustment member supporting the thruster relative to the through-bore, wherein the adjustment member is adjustable and fixable in place relative to the base member to accommodate installation of the thruster at a different axial position in the through-bore so as to accommodate said at least one dimensional variance.

* * * * *